US009261323B2

(12) United States Patent
Springer

(10) Patent No.: US 9,261,323 B2
(45) Date of Patent: Feb. 16, 2016

(54) BOWSTRING RELEASE HAVING A SAFETY DEVICE

(71) Applicant: Copper John Corporation, Auburn, NY (US)

(72) Inventor: Eric C. Springer, Moravia, NY (US)

(73) Assignee: Copper John Corporation, Auburn, NY (US)

( * ) Notice: Subject to any disclaimer, the term of this patent is extended or adjusted under 35 U.S.C. 154(b) by 0 days.

(21) Appl. No.: 14/707,563

(22) Filed: May 8, 2015

(65) Prior Publication Data

US 2015/0241163 A1 Aug. 27, 2015

Related U.S. Application Data

(63) Continuation of application No. 13/361,336, filed on Jan. 30, 2012, now Pat. No. 9,027,540.

(60) Provisional application No. 61/437,458, filed on Jan. 28, 2011.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/31, 35.2, 40, 90
See application file for complete search history.

(56) References Cited

U.S. PATENT DOCUMENTS 228,302 A 6/1880 Beard
229,089 A 6/1880 Burnham
2,819,707 A 1/1958 Kayfes et al.
3,009,454 A 11/1961 Graham
3,656,467 A 4/1972 Halter
3,757,763 A 9/1973 Pinti et al.
3,768,456 A 10/1973 Hansen et al.
3,853,111 A * 12/1974 Stanislawski et al. F41B 5/1469 124/35.2
3,921,668 A 11/1975 Self
3,942,507 A 3/1976 Opal
3,954,095 A 5/1976 Lewis
3,965,884 A * 6/1976 Killian ..... F41B 5/1469 124/35.2
4,036,204 A 7/1977 Scott
4,041,926 A 8/1977 Troncoso, Jr. et al.
4,066,060 A 1/1978 Napier
4,160,437 A 7/1979 Fletcher
4,282,851 A * 8/1981 Lyons ..... F41B 5/1469 124/35.2
4,305,208 A 12/1981 Larson
4,391,263 A 7/1983 Dodge
4,392,475 A * 7/1983 Fletcher ..... F41B 5/1469 124/35.2
4,407,260 A * 10/1983 Lyons ..... F41B 5/1469 124/35.2
4,424,791 A * 1/1984 Muehleisen ..... F41B 5/1469 124/35.2

(Continued)

OTHER PUBLICATIONS

Bow Lock downloaded from http://www.archery history.com/releases/releasespics/release5.jpg on Dec. 23, 2009.

(Continued)

*Primary Examiner* — Alexander Niconovich
(74) *Attorney, Agent, or Firm* — Barclay Damon, LLP

(57) ABSTRACT

A bowstring release has, in one embodiment, a removable safety device. The safety device prevents unintentional releasing of the bowstring. The safety device enables enough movement to provide perceptible output indicating that the release has been at least partially activated.

23 Claims, 10 Drawing Sheets

(56) References Cited

U.S. PATENT DOCUMENTS 4,426,989 A 1/1984 Sutton
4,466,418 A * 8/1984 Jones ..... F41B 5/1469 124/23.1
4,498,448 A * 2/1985 Fletcher ..... F41B 5/1469 124/35.2
4,509,497 A 4/1985 Garvison
4,539,968 A 9/1985 Garvison
4,567,875 A * 2/1986 Fletcher ..... F41B 5/1469 124/35.2
4,569,744 A 2/1986 Walker
4,574,767 A 3/1986 Gazzara
4,584,747 A 4/1986 Katterbach et al.
4,600,622 A 7/1986 Carlson et al.
4,607,947 A 8/1986 Ensing et al.
4,612,907 A 9/1986 Gantt
4,620,523 A 11/1986 Peck
4,625,705 A * 12/1986 Willits ..... F41B 5/1469 124/35.2
4,672,945 A * 6/1987 Carlton ..... F41B 5/1469 124/35.2
4,674,469 A 6/1987 Peck
4,831,997 A 5/1989 Greene
4,854,293 A 8/1989 Roberts
D303,420 S 9/1989 Huber
4,881,516 A 11/1989 Peck
4,887,583 A * 12/1989 Lin ..... F41A 17/08 124/31
4,930,485 A * 6/1990 Kopper ..... F41B 5/1469 124/23.1
4,949,698 A * 8/1990 Burnham ..... F41B 5/1469 124/35.2
4,981,128 A * 1/1991 Garvison ..... F41B 5/1469 124/35.2
4,982,718 A 1/1991 Hamm et al.
5,009,214 A 4/1991 Wilde
5,025,772 A * 6/1991 Stevenson ..... F41B 5/1469 124/35.2
5,056,498 A 10/1991 Scherz
5,056,586 A 10/1991 Bemisderfer
5,067,472 A * 11/1991 Vogel ..... F41B 5/1469 124/35.2
5,092,053 A 3/1992 Roberts
5,184,596 A * 2/1993 Green ..... F41B 5/1469 124/35.2
5,205,268 A 4/1993 Savage
5,215,504 A 6/1993 Wong et al.
5,224,463 A * 7/1993 Townsend ..... F41B 5/1469 124/31
5,247,922 A * 9/1993 Lalonde ..... F41B 5/1469 124/35.2
5,261,581 A 11/1993 Harden
5,273,021 A 12/1993 Tepper
5,307,966 A 5/1994 Inaba et al.
5,323,754 A 6/1994 Pittman et al.
5,424,813 A 6/1995 Schlueter et al.
5,448,983 A 9/1995 Scott
5,460,721 A 10/1995 Goodwin
5,481,807 A 1/1996 Ploot
5,546,924 A 8/1996 Todd
5,554,329 A 9/1996 Monkelbaan et al.
5,595,167 A 1/1997 Scott
5,596,977 A 1/1997 Scott
5,615,662 A 4/1997 Tentler et al.
5,653,214 A 8/1997 Lynn
5,685,286 A 11/1997 Summers
5,692,490 A 12/1997 Walker
5,694,915 A * 12/1997 Summers ..... F41B 5/1469 124/35.2
5,702,494 A 12/1997 Tompkins et al.
5,765,536 A 6/1998 Scott
5,779,904 A 7/1998 Ruderman et al.
5,803,068 A 9/1998 Summers
5,842,916 A 12/1998 Gerrity et al.
5,850,825 A 12/1998 Scott
5,934,679 A 8/1999 Strain et al.
5,937,841 A 8/1999 Summers et al.
5,937,842 A 8/1999 Summers et al.
5,941,225 A 8/1999 Tentler et al.
6,032,661 A * 3/2000 Goff ..... F41B 5/1469 124/35.2
6,302,093 B1 10/2001 Holland
6,460,529 B2 * 10/2002 Pullin ..... F41B 5/1469 124/35.2
6,478,020 B1 * 11/2002 Rentz ..... F41B 5/1469 124/35.2
6,481,430 B1 * 11/2002 Lightcap, Jr. ..... F41B 5/1469 124/35.2
6,481,431 B1 11/2002 Summers
6,508,005 B2 1/2003 Springer
6,567,593 B1 5/2003 Sugawara
6,571,786 B2 * 6/2003 Summers ..... F41B 5/1469 124/35.2
6,584,966 B1 * 7/2003 Summers ..... F41B 5/1469 124/35.2
6,606,984 B2 * 8/2003 Mugg ..... F41B 5/1469 124/35.2
6,631,709 B2 * 10/2003 Carter ..... F41B 5/1469 124/35.2
6,647,976 B2 * 11/2003 Summers ..... F41B 5/1469 124/35.2
6,736,124 B2 * 5/2004 Carter ..... F41B 5/1469 124/35.2
6,763,819 B2 7/2004 Eckert
6,796,037 B1 9/2004 Geffers et al.
6,659,378 B2 5/2005 Summers
6,895,951 B2 * 5/2005 Summers ..... F41B 5/1469 124/35.2
6,925,996 B1 8/2005 Todd
6,945,241 B2 * 9/2005 Pellerite ..... F41G 1/35 124/35.2
6,953,035 B1 * 10/2005 Summers ..... F41B 5/1469 124/35.2
6,957,644 B2 * 10/2005 Simo ..... F41B 5/1469 124/31
D546,916 S 7/2007 Schwerman et al.
7,278,415 B2 10/2007 Jones
D558,915 S 1/2008 Kakuno et al.
7,325,539 B2 * 2/2008 Simo ..... F41B 5/1469 124/31
D597,164 S 7/2009 Jones
7,574,999 B2 * 8/2009 Pardoski, Jr. ..... F41B 5/1469 124/35.2
7,581,536 B2 * 9/2009 Porter ..... F41B 5/1469 124/35.2
7,603,784 B2 10/2009 Erhard
7,654,254 B1 2/2010 Rentz et al.
7,753,043 B1 7/2010 Eckert
7,926,475 B2 * 4/2011 Jones ..... F41B 5/1469 124/35.2
7,946,282 B2 5/2011 Jones
8,082,910 B1 12/2011 Yehle
8,146,578 B2 4/2012 Jones
8,161,956 B2 4/2012 Bednar
8,622,051 B2 1/2014 Summers
8,869,781 B2 10/2014 Jones
9,027,540 B2 5/2015 Springer
2003/0037778 A1 * 2/2003 Carter ..... F41B 5/1469 124/35.2
2003/0154969 A1 8/2003 Carter
2003/0159682 A1 * 8/2003 Pellerite ..... F41G 1/35 124/35.2
2003/0230295 A1 12/2003 Jones
2004/0079351 A1 * 4/2004 Summers ..... F41B 5/1469 124/35.2
2005/0183272 A1 8/2005 Meadows
2007/0181113 A1 8/2007 Porter
2007/0277471 A1 12/2007 Gibson
2008/0149084 A1 * 6/2008 Whalen ..... F41B 5/1469 124/35.2
2008/0251059 A1 10/2008 McPherson
2008/0282560 A1 11/2008 Bradley et al.
2009/0056689 A1 3/2009 Jones
2009/0064978 A1 * 3/2009 Matasic ..... F41B 5/12 124/35.1

(56) References Cited

U.S. PATENT DOCUMENTS

| | | | | |
|---|---|---|---|---|
| 2009/0090342 | A1 | 4/2009 | Freitag et al. | |
| 2009/0095270 | A1 | 4/2009 | Graves | |
| 2009/0159395 | A1 | 6/2009 | Gerrity et al. | |
| 2009/0185868 | A1 | 7/2009 | Masters et al. | |
| 2010/0064535 | A1 | 3/2010 | Kingsbury | |
| 2010/0071909 | A1 | 3/2010 | Winn | |
| 2010/0108047 | A1 | 5/2010 | Jones | |
| 2011/0144639 | A1 | 6/2011 | Govari | |
| 2011/0162669 | A1 | 7/2011 | Kurek et al. | |
| 2011/0168146 | A1* | 7/2011 | Deceuster | F41B 5/1469 124/35.2 |
| 2012/0192844 | A1 | 8/2012 | Springer | |
| 2012/0285431 | A1 | 11/2012 | Summers | |
| 2013/0025578 | A1 | 1/2013 | Jones | |
| 2013/0092140 | A1 | 4/2013 | Rentz | |

OTHER PUBLICATIONS

Various prior art releases (1) downloaded from http://www.archeryhistory.com/releases/releasespics/pse.jpg, on Dec. 23, 2009.
Various prior art releases (2) http://www.archeryhistory.com/releases/releasespics/release4.jpg, on Dec. 23, 2009.
Mamba R1 Swing Away E-Z Adjust downloaded from http://www.cobraarchery.com/c569.html, on Mar. 10, 2010.
Prior art releases (3) downloaded from http://www.archerhistory.com/releases on Jul. 21, 2011.
Prior art releases (4) downloaded from http://www.archerhistory.com/releases on Jul. 21, 2011.
Longhorn Hunter (2010).

* cited by examiner

BOWSTRING RELEASE HAVING A SAFETY DEVICE

CROSS-REFERENCE TO RELATED APPLICATIONS

This application is a continuation of, and claims the benefit and priority of, U.S. patent application Ser. No. 13/361,336 filed on Jan. 30, 2012 which, in turn, is a non-provisional of, and claims the benefit and priority of U.S. Provisional Patent Application No. 61/437,458, filed on Jan. 28, 2011.

FIELD OF THE INVENTION

This invention relates to archery accessories, and more particularly, to a bowstring release having a removable safety pin.

BACKGROUND OF THE INVENTION

Release aids are used to hold a bowstring in the drawn position. The release attaches to the bowstring and pulls the bowstring to the drawn position. The user then activates the release, either by activating a trigger or by twisting the release, to separate the bowstring from the release thereby allowing the bowstring to fire an arrow. The release allows the user to utilize a device with an ergonomic and more secure grip. Additionally, the release provides protection to the users hands from repeated draws and release of the bowstring.

There are two main types of releases, trigger activated releases and back tension releases. Trigger activated release contain a trigger mechanism, which when activated, releases the hook holding the bowstring. Back tension releases do not use a trigger. Instead, when in the drawn position the user gives a slight twist of the release. This activates the release and the hook releases the bowstring. Becoming proficient with back tension releases requires practice to prevent accidental activation of the release resulting in misfired shots, or unexpected release. When applying force during the draw of a bowstring, an expected release could result in the user hitting themselves in the face with great force, potentially causing serious injuries.

For trigger activated releases, there exist safety mechanisms that prevent the trigger from activating the release. However, these types of safety mechanisms are ineffective for back tension releases.

Therefore, a release having a removable safety pin is desired.

Further, a release having a safety pin that allows for feedback as to the exact release point without releasing the bowstring is desired.

SUMMARY OF THE INVENTION

The invention comprises, in one form thereof, a release having a body, a release mechanism attached to the body via a hinge and a safety pin. When the safety pin is engaged, the release mechanism's range of motion is restricted. Thereby, preventing the release from activating and releasing a bowstring.

More particularly, the invention includes a grip for holding the release. A user hooks a bowstring into the bowstring hook and pulls on the release to draw the bow. With the safety pin removed, or stored in the optional storage, the user activates the release. The release mechanism pivots along the hinge allowing the bowstring hook to release to bowstring.

In another form, with the safety pin affixed to the safety lock on the release mechanism, a user draws a bowstring as described above. However, upon activation of the release, the release mechanism is physically blocked by the safety pin. Thereby, preventing the bowstring hook from releasing the bowstring.

In yet another form, the release has a sear. The bowstring hook rests against the sear. Upon activation of the release, the bowstring hook slides off of the sear allowing for the release mechanism to pivot around the hinge pin. With the safety pin engaged, this merely provides a tactile response to the release being activated without allowing the bowstring hook to release the bowstring.

An advantage of the present invention is that the safety pin prevents the release mechanism for releasing the bowstring.

A further advantage of the present invention is that the safety pin allows for shooters to train with the release without fear of accidental release of the bowstring.

An even further advantage of the present invention is that with the safety pin engaged, the release provides a tactile response that the release has been activated.

Another advantage of the present invention is that the release contains a storage compartment for the safety pin when not in use.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
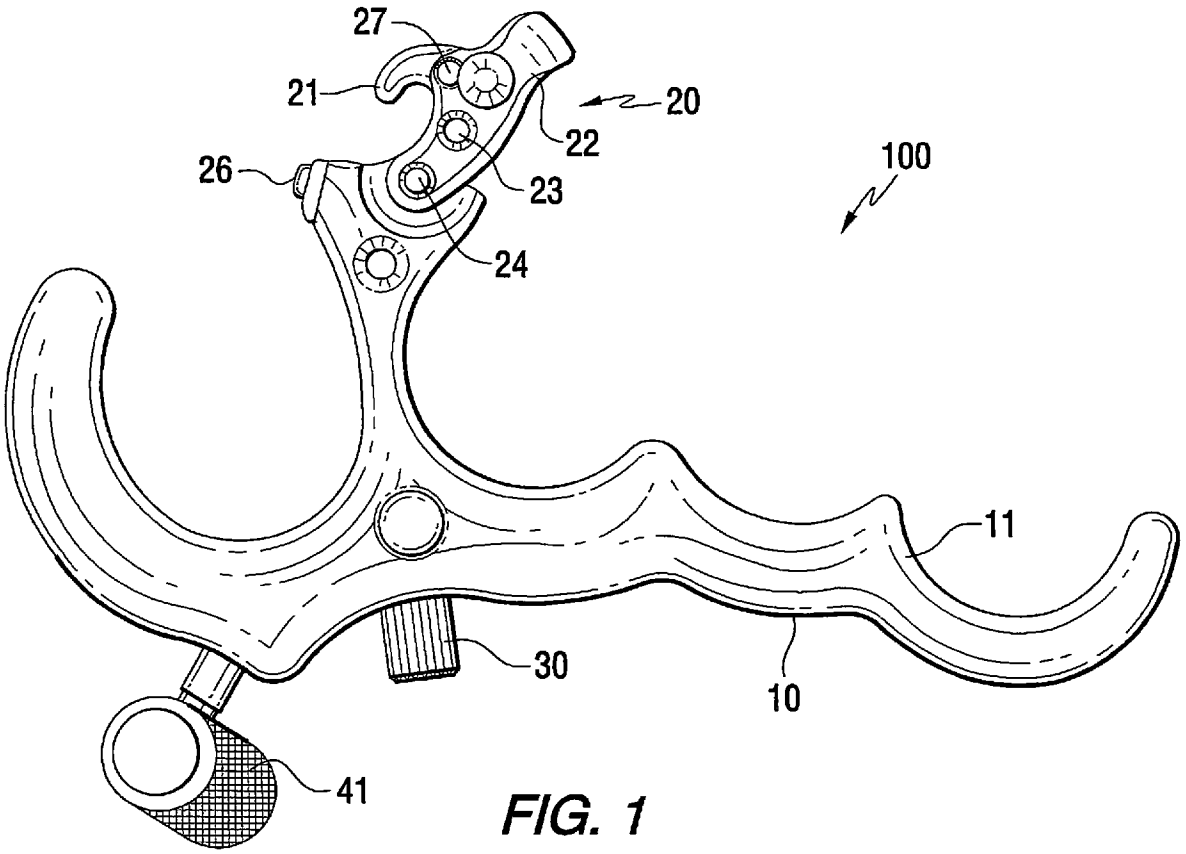
FIG. 1 depicts a release according to one embodiment.

Referring to FIG. 1, there is shown the bowstring release according to one embodiment of the present invention. The release 100 includes a body 10, a release mechanism 20 and a safety pin 30. Optionally, the release 100 includes a pulling post assembly 40. In one embodiment, the body 10 further contains a safety pin storage 12. In embodiments in which the safety pin 30 is a threaded safety pin, the safety pin storage may have a threaded portion to receive and secure the safety pin 30 in place.

Figure 2A:
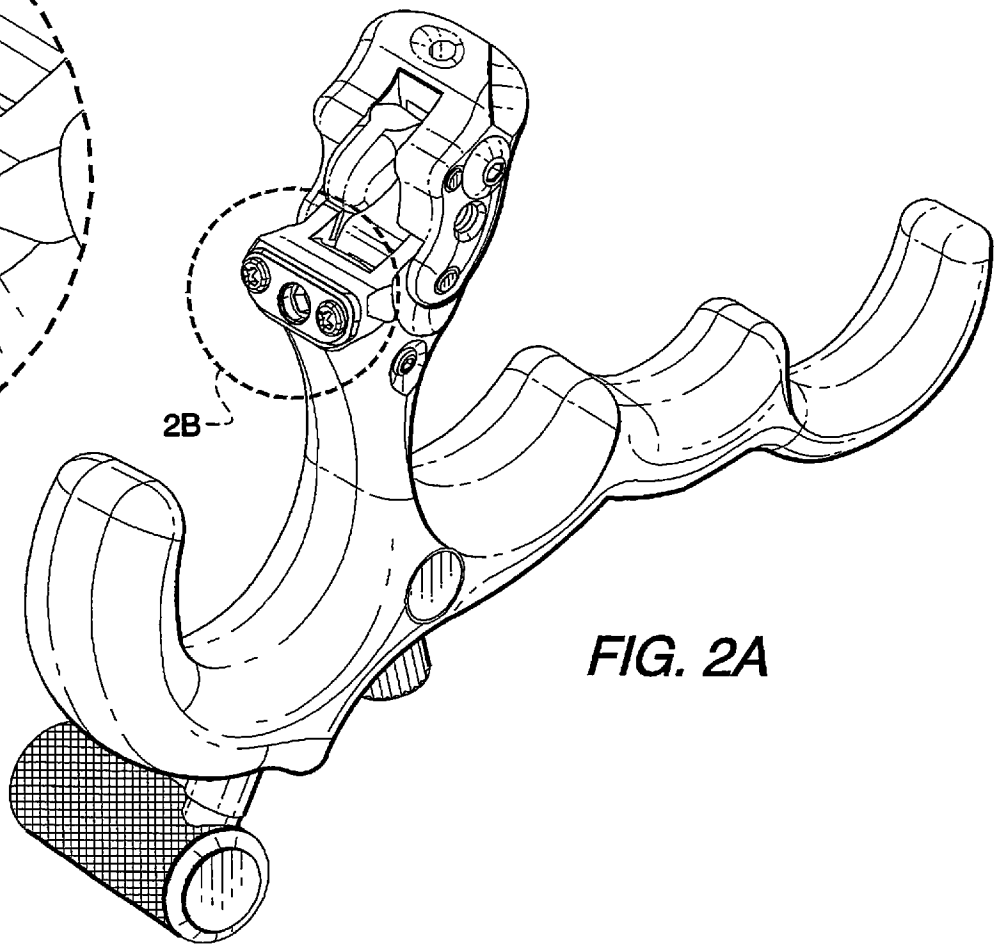
FIG. 2A depicts an isometric view of the release shown in FIG. 1.
Figure 2B:
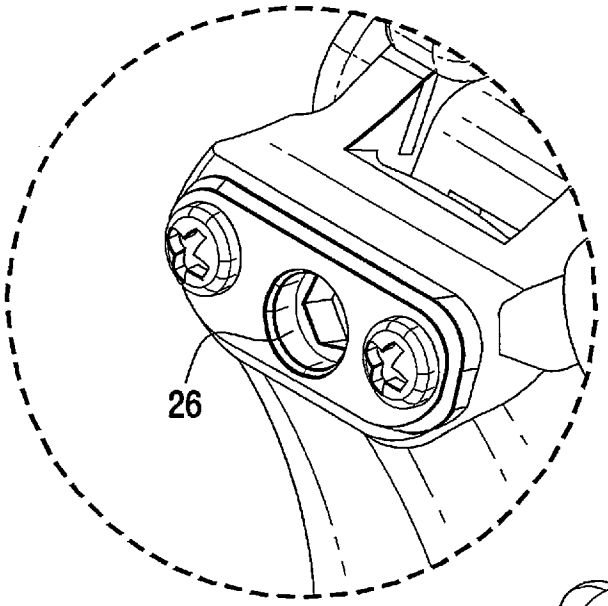
FIG. 2B is an enlarged view of the sear adjustment shown in FIG. 2A.

Referring now to FIGS. 2A-2B, a release mechanism 20 is affixed to the body 10 via hinge pin 24. The hinge pin 24 allows the hinged release 22 to pivot along the axis defined by the hinge pin 24. A bowstring hook 21 is attached to the hinged release 22 via a bowstring hinge pin 27 allowing the bowstring hook 21 to pivot along the axis defined by the bowstring hinge pin 27. A safety lock hole 23 allows for attachment of the safety pin 30 (shown in FIGS. 6-9). In one embodiment a sear 25 is attached to the body 10. In use, the bowstring hook 21 rests against the sear 25 as a bowstring is pulled into the drawn position. When the release 100 is activated the bowstring hook 21 slides off of the sear 25 allowing the hinged release 22 and the bowstring hook 21 to pivot and release a bowstring (not shown). It is understood that the bowstring hook may be an open hook or a closed hook depending on the particular embodiment.

FIG. 2B depicts an enlarged view of the sear adjustment 26. By adjusting the positioning of the sear 25, the user can fine tune the release point of the bowstring hook 21.

Figure 3D:
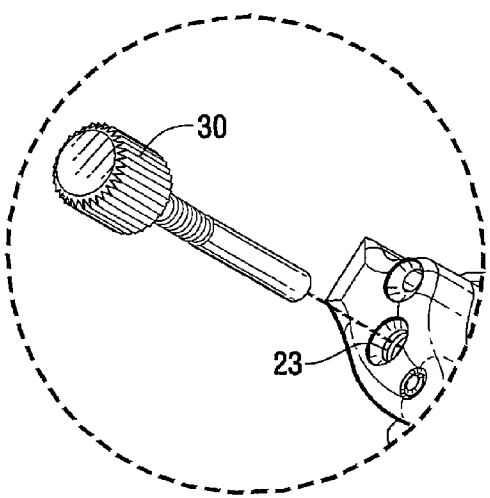
FIGS. 3A-3F depict various options for storing and engaging the safety pin.
Figure 3C:
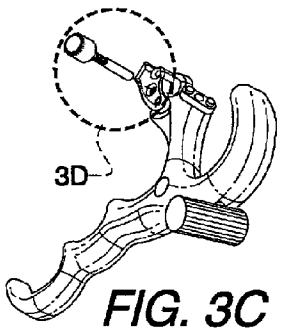
Figure 3A:
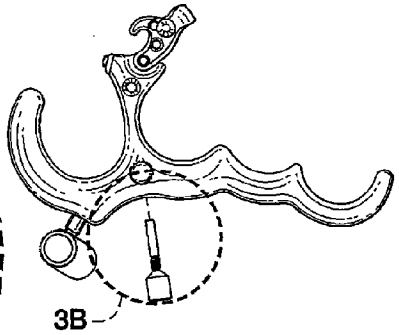
Figure 3B:
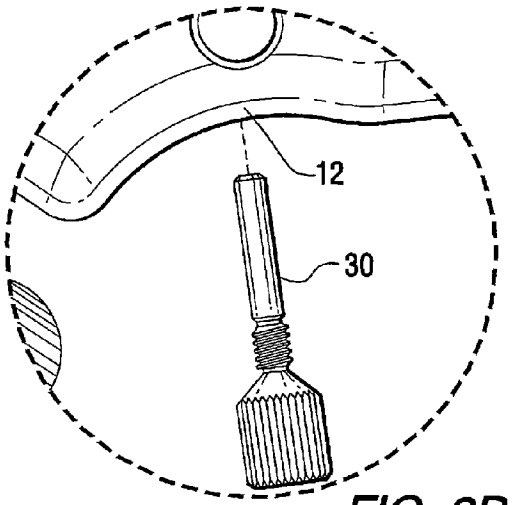
Figure 3F:
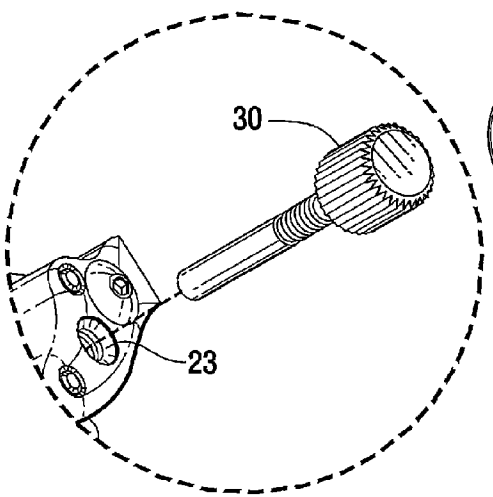
Figure 3E:
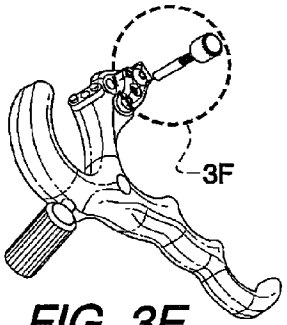

Referring now to FIGS. 3A-3F, there is shown the safety pin 30 used for various purposes. In the embodiments shown the safety pin is a threaded safety pin. FIG. 3B is an enlarged view of the section circled in FIG. 3A. The safety pin 30 is placed in the safety pin storage 12 on the body 10 when not in use. FIGS. 3D and 3F are enlarged views of the circled areas of FIGS. 3C and 3E respectively. The safety pin 30 may be placed into either side of the safety lock 23. This is advantageous as the device can be used for both left-handed and right-handed shooters. While the safety pin is shown as a cylindrical pin, it is understood that the safety pin may be of any shape so long as it physically blocks the bowstring hook 21.

Figure 4:
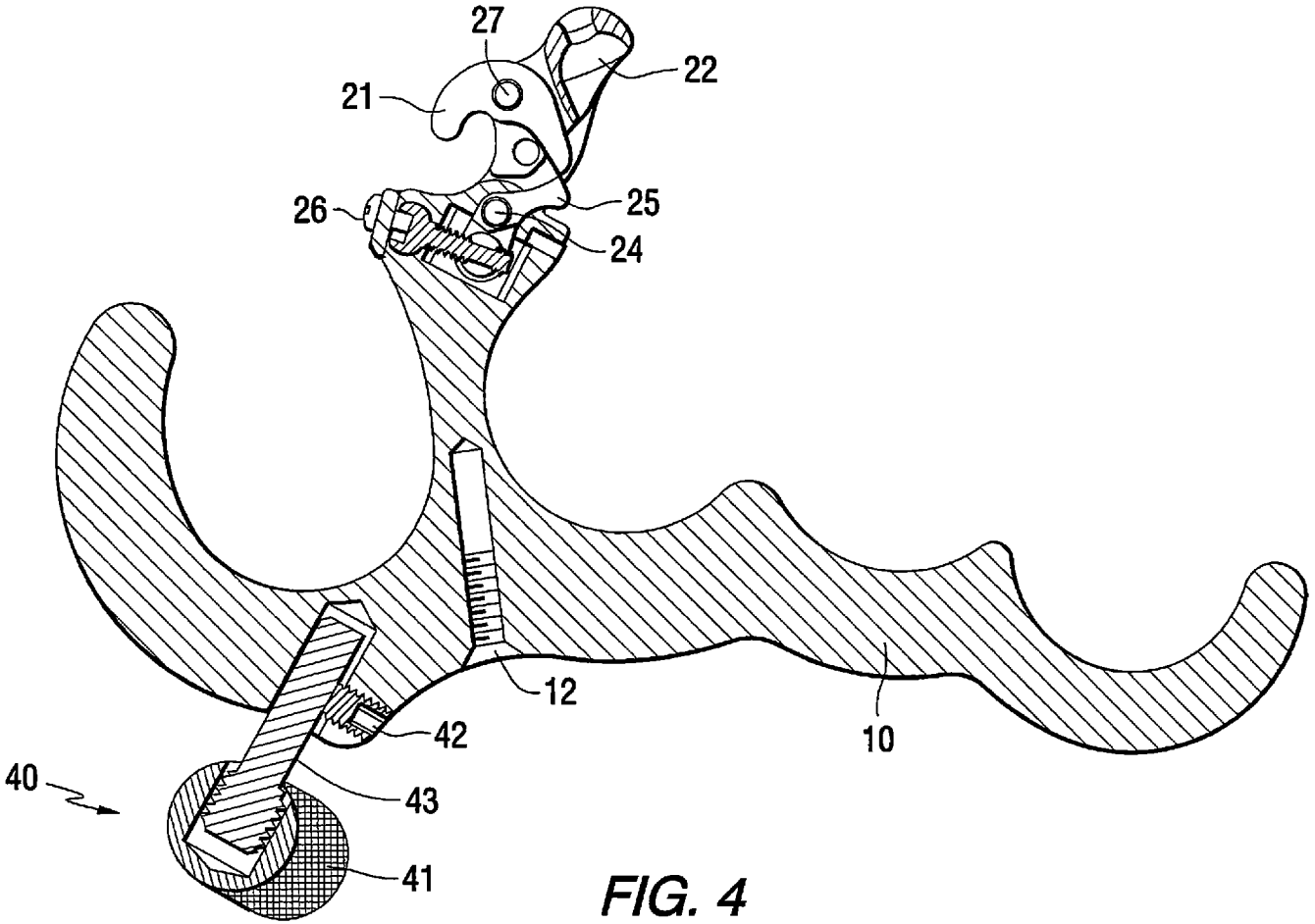
FIG. 4 is a schematic view of the release shown in FIG. 1 in the drawn position.

Referring now to FIG. 4, there is shown a schematic view of release 100 in the drawn position. In one embodiment, the release includes a pulling post assembly 40. Optionally, the pulling post assembly 40 is an adjustable pulling post assembly having a pulling post 41 attached to a threaded post 43. The threaded post 43 being held into position on the body 10 by a set screw 42. This allows the pulling post 41 to be angled and moved to the users preference. In another embodiment, the pulling post assembly 40 is a trigger mechanism used to activate the release.

Figure 5:
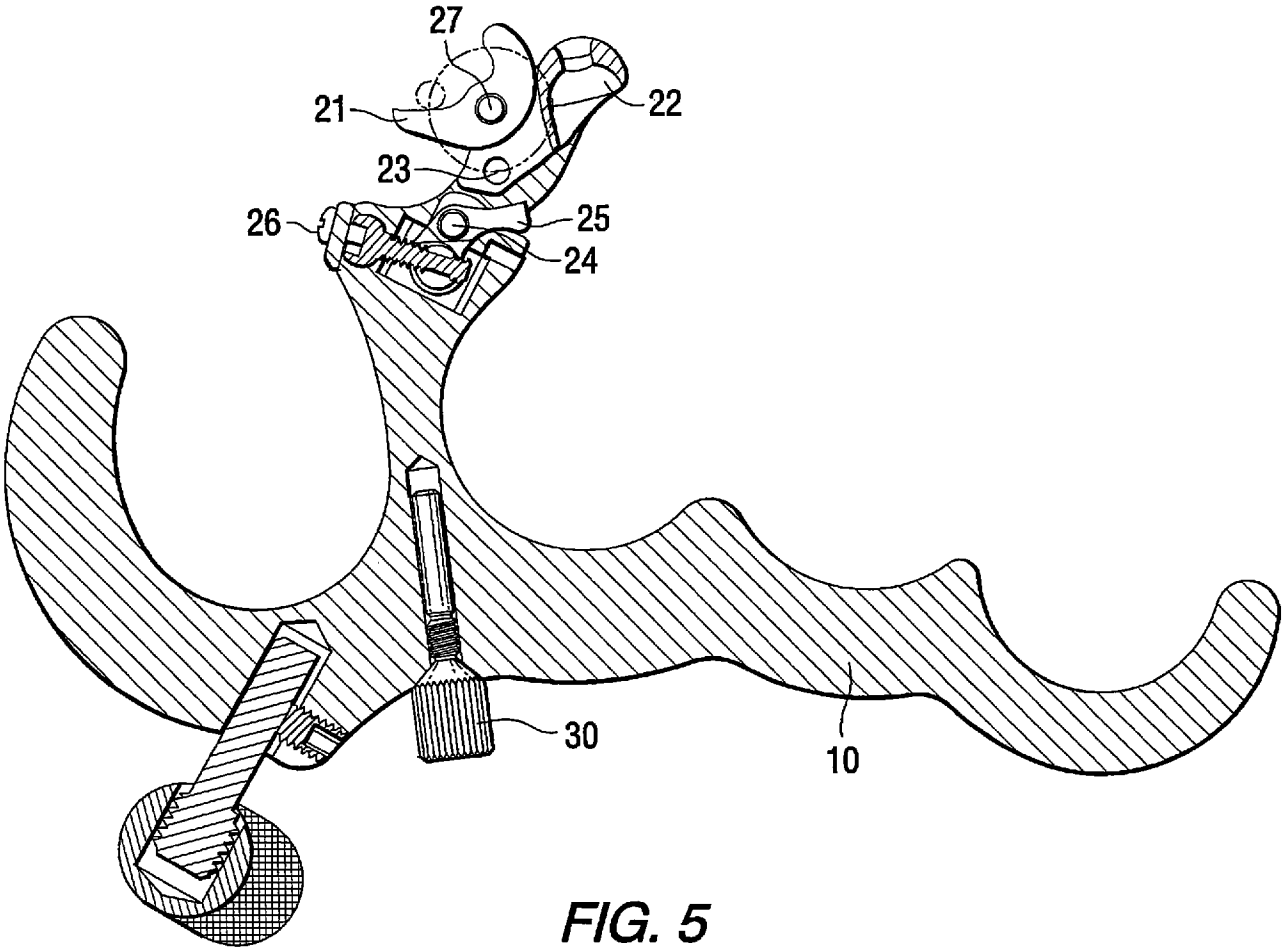
FIG. 5 is a schematic view of the release shown in FIG. 1 in the release position.

Still referring to FIG. 4, there is shown the release mechanism 20. The bowstring hook 21 rests along the sear 25. When under tension, the bowstring hook 21 remains pressed against the sear 25 until the release is activated. As shown in FIG. 5, the release 100 has been activated. The bowstring hook 21 has moved off of the sear 25 and the tension from the bowstring allows the bowstring hook 21 and the hinged release 22 to move into the released position, thereby releasing the bowstring.

With the safety pin 30 in the safety lock 23 the release mechanism 20 cannot fully activate. When the bowstring is drawn the release 100 is in the position shown in FIG. 4 with the bowstring hook 21 resting on the sear 25. When activated, the bowstring hook 21 slips off the sear 25 only instead of fully releasing, the bowstring hook 21 physically comes in contact with safety pin 30. This prevents the bowstring hook 21 from fully pivoting and releasing the bowstring. However, because the bowstring hook 21 does slip off the sear 25, the user is giving a tactile feel that the release has been activated. In one embodiment, this slipping also produces an audible sound.

Figure 6:
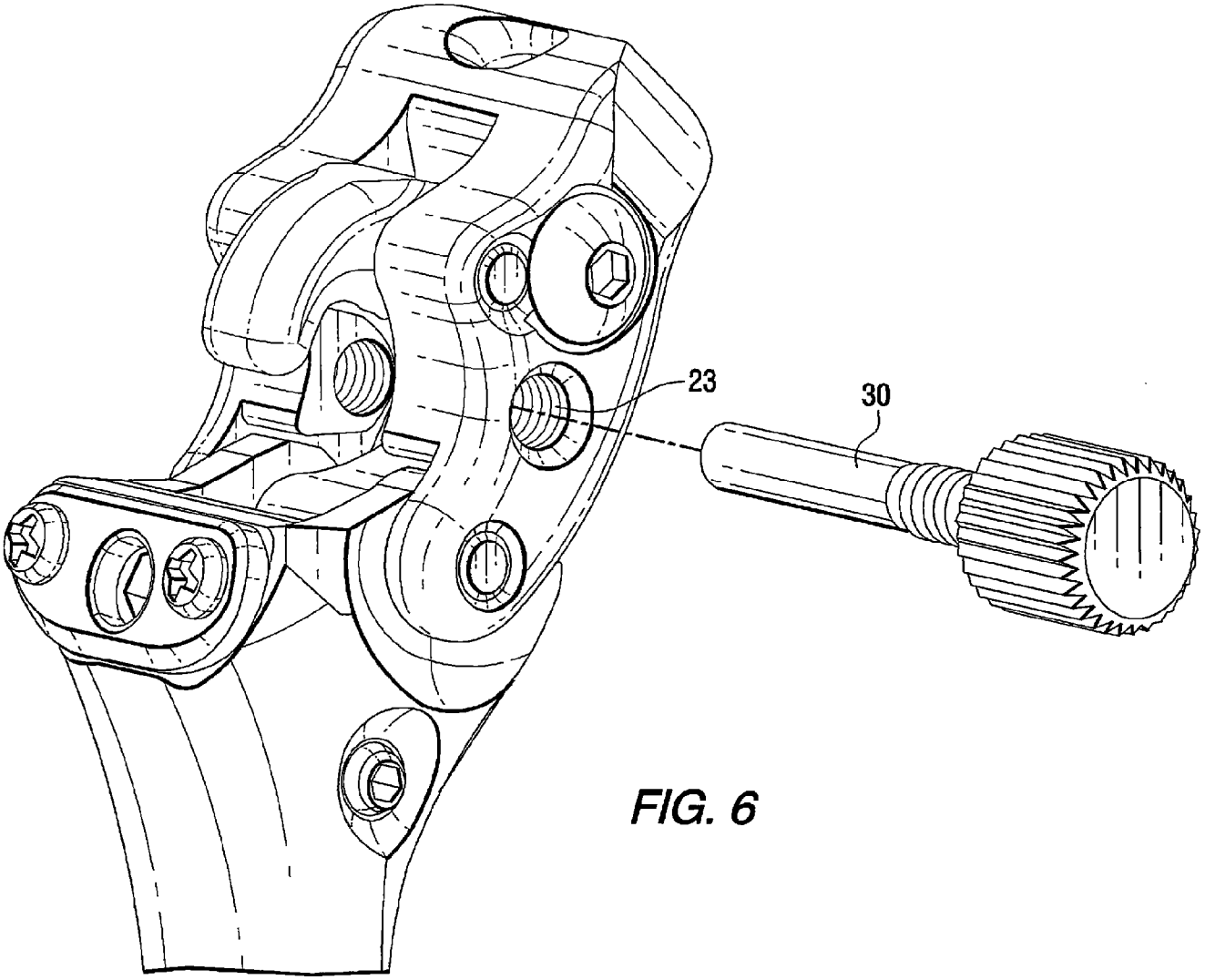
FIG. 6 depicts an enlarged view of the release mechanism with the safety pin removed.
Figure 7:
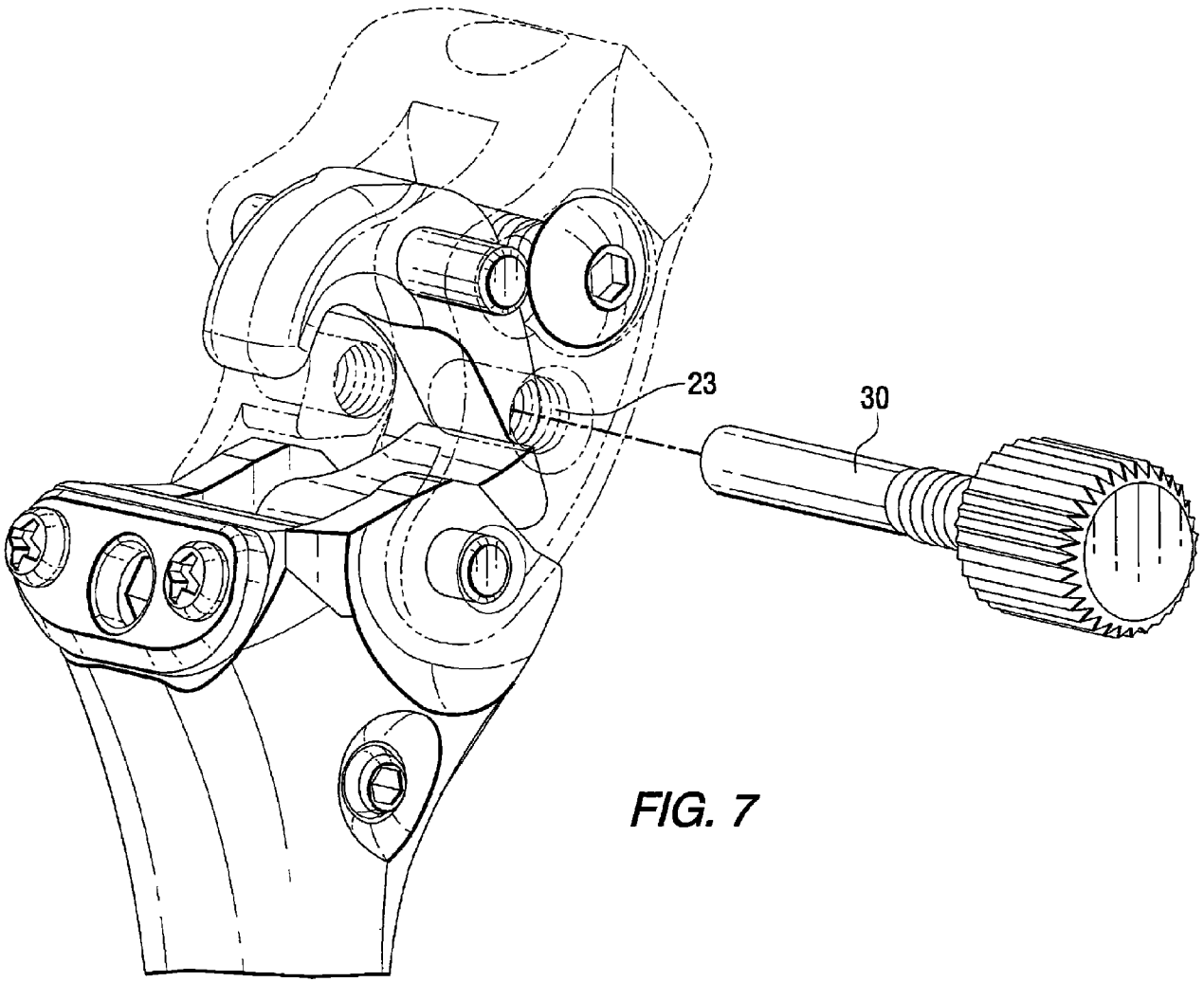
FIG. 7 is a transparent enlarged view of the release mechanism with the safety pin removed as shown in FIG. 6.
Figure 8:
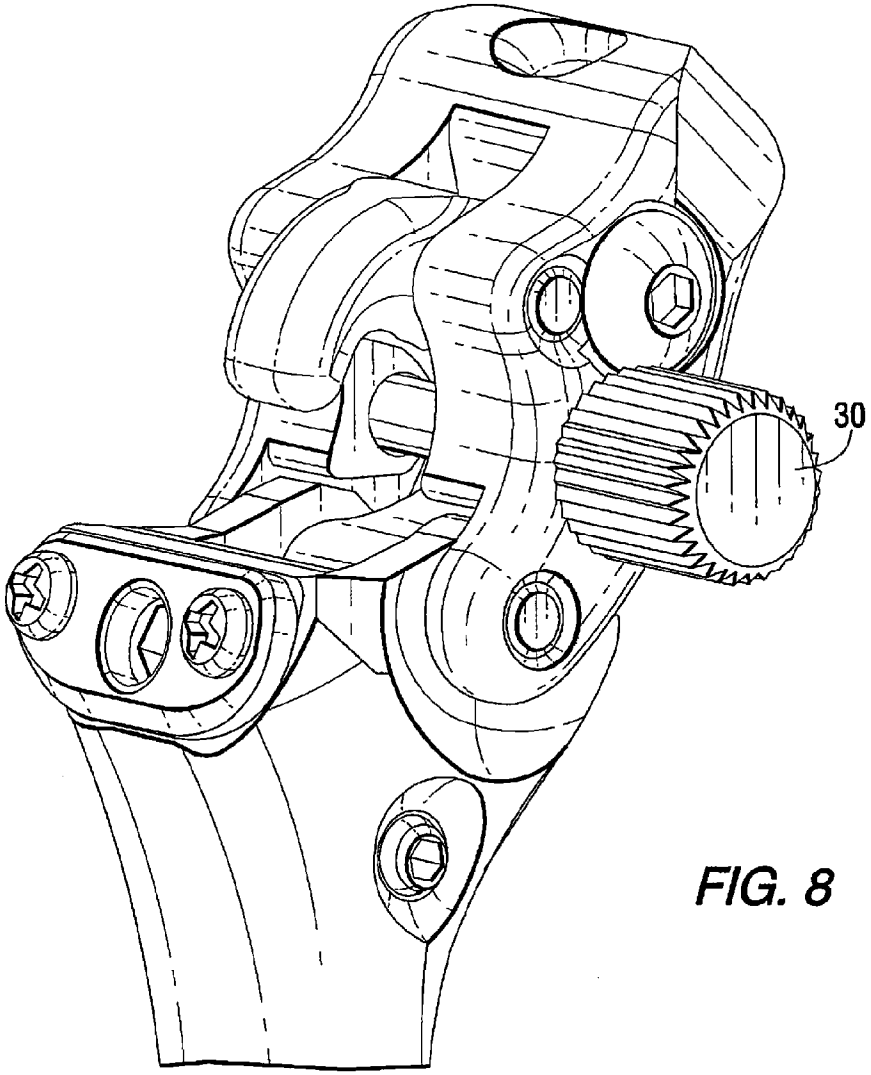
FIG. 8 depicts an enlarged view of the release mechanism with the safety pin engaged.
Figure 9:
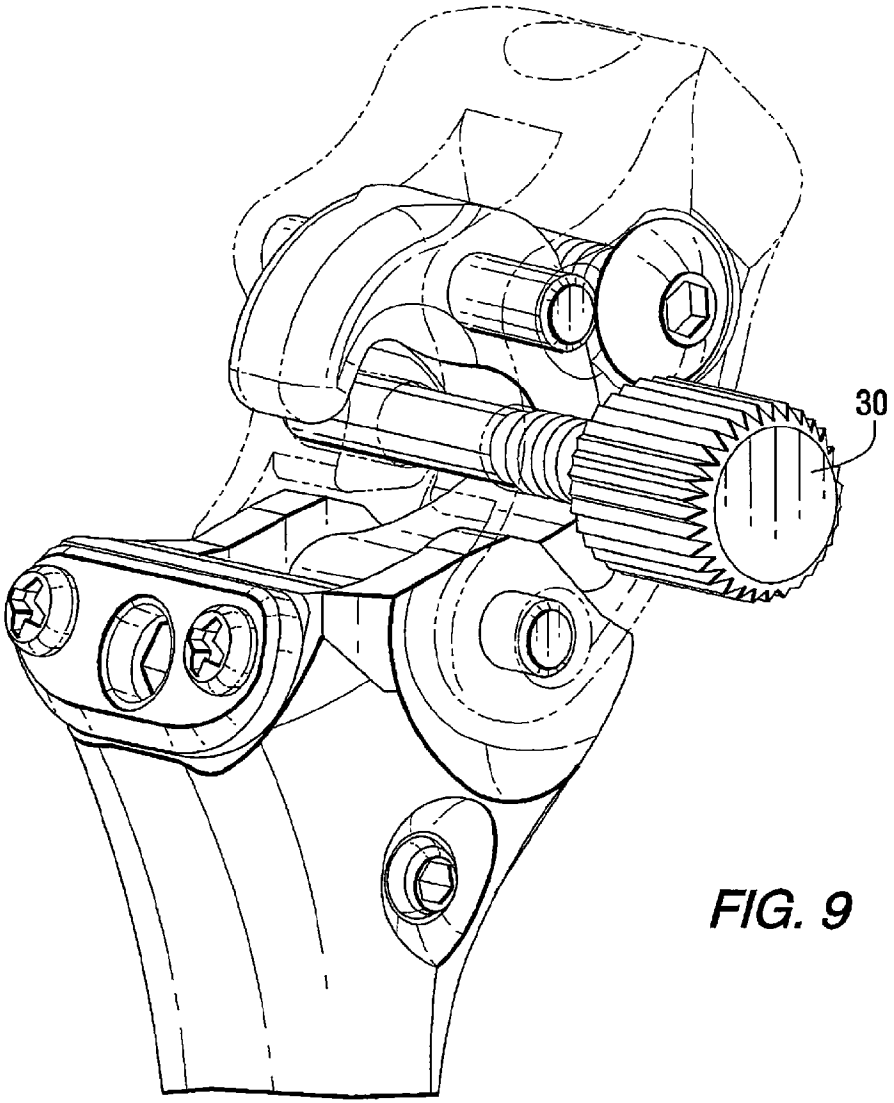
FIG. 9 is a transparent enlarged view of the release mechanism with the safety pin engaged as shown in FIG. 8.
Figure 10A:
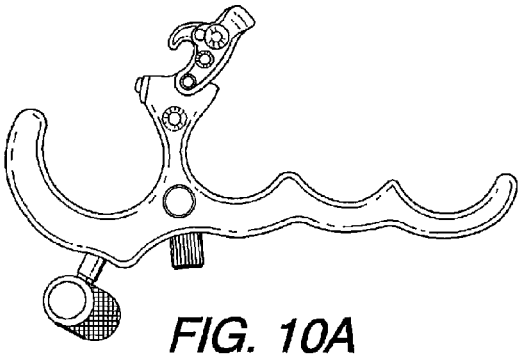
FIGS. 10A-10E depict releases according to various additional embodiments.
Figure 10D:
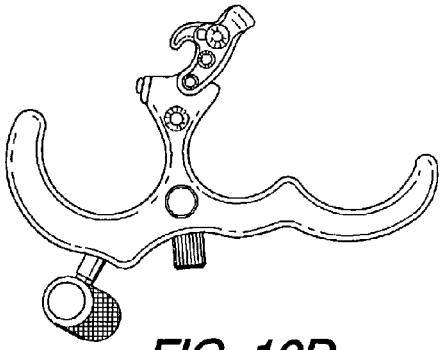
Figure 10B:
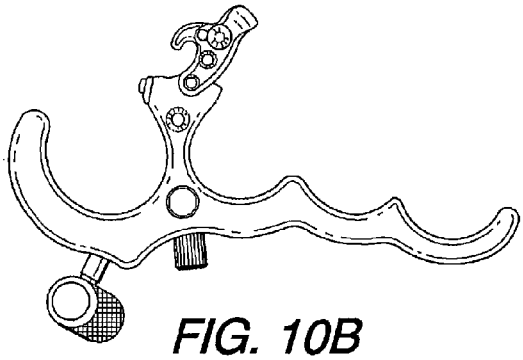
Figure 10E:
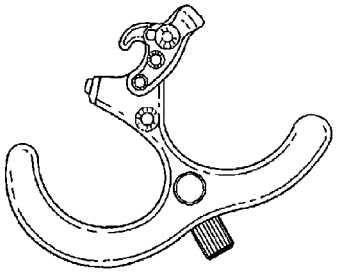
Figure 10C:
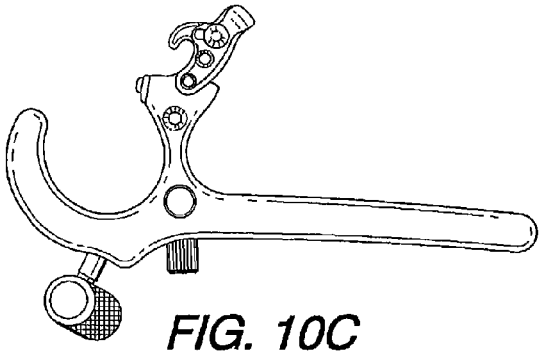

Referring to FIGS. 6 and 7 there is shown an enlarged view of the release mechanism with the safety pin 30 removed. To engage the safety pin 30, it is threaded into the safety lock hole 23 to lock the device as shown in FIGS. 8 and 9. The safety pin 30 physically prevents the bowstring hook from fully releasing a bowstring when engaged.

Referring now to FIGS. 10A-10E, there are shown various releases. It is understood that the examples are merely demonstrative and are not intended to be limiting. For example, closed loop grips and the such may be substituted for the open design. In addition, the pulling post may be replaced with a trigger mechanism changing the release from a back tension release to a trigger type release. Also a trigger mechanism as known to those skilled in the art my be added at locations other than the pulling post.

In use, a shooter uses the release 100 to draw a bowstring. The bowstring hook 21 secures the bowstring and the shooter pulls back on the body 10. The bowstring hook 21 rests against the sear 25. When the release 100 is activated, the bowstring hook 21 slides off the sear 25 allowing the release mechanism to release the bowstring. However, if the safety pin 30 is placed in the safety lock 23, the bowstring hook 21 physically contacts the safety pin 30. This prevents the bowstring hook 21 from full range of motion and retains the bowstring in the bowstring hook. The slight movement of the bowstring hook 21 provides the user with a tactile signal that the release had been activated allowing for better training and fine tuning.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

PARTS LIST

10 Body
11 Grip
12 Safety pin storage
20 Release mechanism
21 Bowstring hook
22 Hinged release
23 Safety lock hole
24 Hinge pin
25 Sear
26 Sear adjustment
27 Bowstring hook hinge
30 Safety pin
40 Pulling post assembly
41 Pulling post
42 Set screw
43 Threaded post
100 Release The following is claimed:

1. A bowstring release comprising:

a body;

a sear coupled to the body;

a hinge extending along an axis;

a release mechanism comprising a bowstring holder, the bowstring holder being coupled to the hinge, the bowstring holder being pivotal about the axis between:

(a) a non-release position in which the bowstring holder is positioned to hold a bowstring when the bowstring holder is engaged with the sear; and (b) a release position in which the bowstring holder is positioned to release the bowstring after the bowstring holder is disengaged from the sear; and a safety device configured to be coupled to the release mechanism so that, when the bowstring holder is disengaged from the sear, the safety device is configured to:

(a) enable movement of the bowstring holder from the non-release position to an intermediate position between the non-release position and the release position; and (b) prevent the bowstring holder from moving to the release position, wherein the movement to the intermediate position causes an output perceptible by a user; and wherein the prevention of the movement to the release position prevents an unintentional release of the bowstring.

2. The bowstring release of claim 1, wherein: (a) the safety device comprises a safety pin; and (b) the bowstring holder comprises a bowstring hook.

3. The bowstring release of claim 2, wherein the release mechanism defines an opening configured to receive at least part of the safety device.

4. The bowstring release of claim 1, wherein the release mechanism comprises a safety lock configured to cooperate with the safety device.

5. The bowstring release of claim 1, wherein the body defines a safety device holder configured to hold the safety device when the safety device is not being used.

6. The bowstring release of claim 1, wherein the bowstring holder is configured to disengage from the sear when the bowstring holder is subject to a level of force.

7. The bowstring release of claim 1, wherein the sear is moveably coupled to the body.

8. The bowstring release of claim 1, wherein the output is selected from the group consisting of: (a) a tactile output; and (b) an audible output.

9. The bowstring release of claim 1, wherein:

the bowstring release is selected from the group consisting of a trigger-based release device, a triggerless release device, and a back tension release device;

the bowstring is configured to produce a bowstring force acting toward a target;

the bowstring holder comprises a hook, the hook configured to hold the bowstring until the hook is pivoted, relative to the bowstring, to the release position to enable the bowstring to slide out of the hook due to the bowstring force; and the hook and the safety device are configured to cooperate so that, as a result of the bowstring holder being disengaged from the sear:

the hook pivots until striking a portion of the safety device;

the portion of the safety device brings the hook to a stop at the intermediate position, preventing the hook from pivoting to the release position; and the hook's striking of the portion of the safety device causes the output, the output being selected from the group consisting of a sound and a vibration, wherein the output is helpful in learning how to operate the bowstring release.

10. A bowstring release comprising:

a body;

a bowstring holder pivotally coupled to the body, the bowstring holder being pivotal from a first position associated with holding of a bowstring to a second position associated with releasing of the bowstring;

a sear supported by the body, the sear configured to restrain the bowstring holder in the first position until the bowstring holder is subject to a level of force; and a safety member attachable to the body, the safety member being configured so that, when the bowstring holder is unrestrained by the sear:

(a) the bowstring holder moves from the first position to an intermediate position where the bowstring holder contacts the safety member; and (b) the safety member prevents the bowstring holder from moving to the second position so as to prevent an unintentional release of the bowstring.

11. The bowstring release of claim 10, which comprises a hinge that pivotally couples the bowstring holder to the body, the hinge extending along an axis, the bowstring holder being pivotal about the axis.

12. The bowstring release of claim 11, wherein the safety member is configured to bring the bowstring holder to a stop at the intermediate position after the bowstring holder has traveled and generated a momentum, the bowstring holder striking the safety member so as to generate an output based on the momentum, the output facilitating training in use of the bowstring release.

13. The bowstring release of claim 12, wherein:

the bowstring is configured to produce a bowstring force acting toward a target; and the bowstring holder comprises a hook, the hook configured to hold the bowstring until the hook is pivoted, relative to the bowstring, to the second position to enable the bowstring to slide out of the hook due to the bowstring force.

14. The bowstring release of claim 13, wherein the safety member comprises a safety pin.

15. The bowstring release of claim 14, wherein the bowstring release defines an opening configured to receive at least part of the safety member.

16. The bowstring release of claim 15, wherein the bowstring release comprises a safety lock configured to cooperate with the safety member.

17. The bowstring release of claim 16, wherein the body defines a safety member holder configured to hold the safety member when the safety member is not being used.

18. The bowstring release of claim 13, wherein the output is selected from the group consisting of: (a) a tactile output; and (b) an audible output.

19. The bowstring release of claim 10, wherein:

the bowstring release is selected from the group consisting of a trigger-based release device, a triggerless release device, and a back tension release device;

the bowstring is configured to produce a bowstring force acting toward a target;

the bowstring holder comprises a hook, the hook configured to hold the bowstring until the hook is pivoted, relative to the bowstring, to the second position to enable the bowstring to slide out of the hook due to the bowstring force; and the hook and the safety member are configured to cooperate so that, as a result of the bowstring holder being unrestrained by the sear:

the hook pivots until striking the safety member;

the safety member brings the hook to a stop at the intermediate position, preventing the hook from pivoting to the second position; and the hook's striking of the safety member causes an output, the output being selected from the group consisting of a sound and a vibration, wherein the output is helpful in learning how to operate the bowstring release.

20. A bowstring release comprising:

a body;

a sear supported by the body;

a bowstring holder pivotally coupled to the body, the bowstring holder being pivotal between:

(a) a non-release position in which the bowstring holder is positioned to hold a bowstring when the sear blocks movement of the bowstring holder; and (b) a release position in which the bowstring holder is positioned to release the bowstring after the bowstring holder is unblocked by the sear; and a safety device attachable to the body, the bowstring holder and the safety device being configured to cooperate so that, after the bowstring holder is unblocked by the sear:

the bowstring holder moves through a range of motion until striking the safety device; and the safety device blocks the bowstring holder from moving to the release position, wherein, due to the bowstring holder's striking of the safety device, an impact occurs, wherein the impact provides feedback to facilitate training in use of the bowstring release.

21. The bowstring release of claim 20, wherein the safety device comprises a safety pin.

22. The bowstring release of claim 21, wherein:

(a) the release defines an opening configured to receive at least part of the safety device;

(b) the release comprises a safety lock configured to cooperate with the safety device;

(c) the body defines a safety device holder configured to hold the safety device when the safety device is not being used; and (d) the bowstring holder is configured to slide out of contact with the sear when the bowstring holder is subject to a level of force.

23. The bowstring release of claim 20, wherein:

the bowstring release is selected from the group consisting of a trigger-based release device, a triggerless release device, and a back tension release device;

the bowstring is configured to produce a bowstring force acting toward a target;

the bowstring holder comprises a hook, the hook configured to hold the bowstring until the hook is pivoted, relative to the bowstring, to the release position to enable the bowstring to slide out of the hook due to the bowstring force; and the hook and the safety device are configured to cooperate so that, as a result of the bowstring holder being disengaged from the sear:

the hook pivots until striking the safety device;

the safety device brings the hook to a stop at an intermediate position between the non-release position and the release position, preventing the hook from pivoting to the release position; and the feedback is selected from the group consisting of a sound and a vibration, wherein the feedback is helpful in learning how to operate the bowstring release.

* * * * *